US007258102B2

(12) United States Patent
Kinose et al.

(10) Patent No.: US 7,258,102 B2
(45) Date of Patent: Aug. 21, 2007

(54) CONTROL DEVICE FOR INTERNAL COMBUSTION ENGINE

(75) Inventors: Kenichi Kinose, Okazaki (JP); Tatsuya Tahara, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 19 days.

(21) Appl. No.: 11/354,056

(22) Filed: Feb. 15, 2006

(65) Prior Publication Data

US 2006/0207559 A1 Sep. 21, 2006

(30) Foreign Application Priority Data

Mar. 18, 2005 (JP) ..... 2005-078460

(51) Int. Cl.
*F02D 41/04* (2006.01)

(52) U.S. Cl. ..... 123/431; 123/674; 123/575

(58) Field of Classification Search ..... 123/431, 123/674, 575, 576
See application file for complete search history.

(56) References Cited

U.S. PATENT DOCUMENTS 5,832,901 A * 11/1998 Yoshida et al. ..... 123/478
5,878,711 A * 3/1999 Kamura et al. ..... 123/295

FOREIGN PATENT DOCUMENTS

| | | |
|---|---|---|
| JP | A-03-185242 | 8/1991 |
| JP | A-4-183949 | 6/1992 |
| JP | A-5-231221 | 9/1993 |
| JP | A-2005-048730 | 2/2005 |
| JP | A-2005-214015 | 8/2005 |

* cited by examiner

*Primary Examiner*—Erick Solis
(74) *Attorney, Agent, or Firm*—Oliff & Berridge, PLC

(57) ABSTRACT

An engine ECU executes a program including the steps of: detecting an air-fuel ratio; calculating a learn value of a feedback correction amount for total fuel injection amount calculated based on the air-fuel ratio, for a plurality of learning regions obtained as a result of division corresponding to an intake air amount; interpolating the learn value at an intake air amount different from the intake air amount detected at the time of calculation of the learn value, based on the calculated learn value; and correcting an amount of fuel injection based on the obtained learn value.

30 Claims, 10 Drawing Sheets

CONTROL DEVICE FOR INTERNAL COMBUSTION ENGINE

This nonprovisional application is based on Japanese Patent Application No. 2005-078460 filed with the Japan Patent Office on Mar. 18, 2005, the entire contents of which are hereby incorporated by reference.

BACKGROUND OF THE INVENTION

1. Field of the Invention

The present invention relates to a control device for an internal combustion engine that includes a first fuel injection mechanism (in-cylinder injector) injecting fuel into a cylinder and a second fuel injection mechanism (intake manifold injector) injecting fuel into an intake manifold or an intake port, and more particularly to a technique to correct an amount of fuel injection from the first fuel injection mechanism and the second fuel injection mechanism.

2. Description of the Background Art

An internal combustion engine provided with an intake manifold injector for injecting fuel into an intake manifold and an in-cylinder injector for constantly injecting fuel into a combustion chamber, in which fuel injection from the intake manifold injector is stopped when load of the engine is lower than preset load and fuel injection from the intake manifold injector is allowed when load of the engine is higher than the preset load, is known.

Even in such an internal combustion engine, a desired amount of fuel injection may not be attained due to deposits accumulated in the injector or difference between individual engines caused during manufacturing. Namely, an air-fuel ratio may deviate from a desired air-fuel ratio (for example, stoichiometric air-fuel ratio). In order to correct such deviation in the amount of fuel injection, the amount of fuel injection is corrected by feedback control of the air-fuel ratio, as in an internal combustion engine including one injector for each cylinder.

Japanese Patent Laying-Open No. 03-185242 discloses a fuel injection amount control device for an internal combustion engine that accurately corrects an amount of fuel injection in the internal combustion engine including a plurality of fuel injection valves for each cylinder. The fuel injection amount control device includes a control unit controlling fuel injection from the plurality of fuel injection valves in accordance with an operation state, a learning unit learning a value based on an output signal from an oxygen sensor provided in an exhaust system of the engine so as to correct the amount of fuel injection, a setting unit setting a plurality of learning regions corresponding to states of use of the plurality of fuel injection valves, and a correction unit using each learn value learned in the learning region to correct the amount of fuel injection in the operation state corresponding to each learning region.

According to the fuel injection amount control device described in this publication, as the fuel injection valve used in the learning region is the same as that used in correcting the amount of fuel injection with the learn value, accuracy in correcting the amount of fuel injection is improved. Therefore, follow-up characteristic of the air-fuel ratio is enhanced and exhaust emission is improved. In addition, as deviation from a target air-fuel ratio becomes small, possibility of misfire is suppressed and fuel efficiency can be improved even if a leaner air-fuel ratio is set.

Even if a learn value is learned in each learning region corresponding to each state of use of a plurality of fuel injection valves as in the fuel injection amount control device according to Japanese Patent Laying-Open No. 03-185242, however, the learn value in all operation states cannot be learned. Japanese Patent Laying-Open No. 03-185242 includes no disclosure of how to obtain a learn value in an operation state in which an occasion to learn a learn value could not be obtained. Therefore, correction of the amount of fuel injection based on the learn value may be inappropriate.

SUMMARY OF THE INVENTION

An object of the present invention is to provide a control device for an internal combustion engine capable of appropriately correcting an amount of fuel injection.

A control device for an internal combustion engine according to one aspect of the present invention controls an internal combustion engine including a first fuel injection mechanism injecting fuel into a cylinder and a second fuel injection mechanism injecting fuel into an intake manifold. The control device includes: a first control unit controlling the fuel injection mechanism so that the fuel is injected solely from the first fuel injection mechanism in a first injection region; a second control unit controlling the fuel injection mechanism so that the fuel is injected solely from the second fuel injection mechanism in a second injection region; a third control unit controlling the fuel injection mechanism so that the fuel is injected from the first fuel injection mechanism and the second fuel injection mechanism in a third injection region; a detection unit detecting an amount of air suctioned into the internal combustion engine; a first correction value calculation unit calculating a first correction value for an amount of fuel injection in the first injection region, for a plurality of learning regions obtained as a result of division corresponding to the amount of air; a second correction value calculation unit calculating a second correction value for an amount of fuel injection in the second injection region, for the plurality of learning regions; a third correction value calculation unit calculating a third correction value for an amount of fuel injection in the third injection region, for the plurality of learning regions; a first calculation unit calculating a correction value for an amount of fuel injection at an amount of air different from the amount of air detected when the first correction value is calculated, based on the first correction value; a second calculation unit calculating a correction value for an amount of fuel injection at an amount of air different from the amount of air detected when the second correction value is calculated, based on the second correction value; and a third calculation unit calculating a correction value for an amount of fuel injection at an amount of air different from the amount of air detected when the third correction value is calculated, based on the third correction value.

According to the present invention, the correction value for the amount of fuel injection in each injection region is calculated for the plurality of learning regions obtained as a result of division corresponding to the amount of air. The correction value at the amount of air different from the amount of air detected at the time of calculation of the correction value is calculated by each calculation unit based on the correction value calculated in each injection amount region. For example, when the first correction value in the first injection region is calculated in two learning regions, that is, when there are two first correction values calculated, two points are connected by a straight line, so that the correction value with regard to the amount of air between the two points is calculated (interpolated). The correction value is interpolated similarly in the second and third injection regions. Accordingly, the correction value at the amount of air different from the detected amount of air can be calculated for each injection region, and an appropriate correction value in accordance with an amount of intake air can be calculated. A fuel injection portion is controlled such that the fuel injection amount is corrected based on such a correction value. Consequently, a control device for an internal combustion engine capable of appropriately correcting an amount of fuel injection can be provided.

Preferably, the first calculation unit calculates the correction value for the amount of fuel injection at the amount of air different from the amount of air detected when a plurality of first correction values are calculated, based on the plurality of first correction values. The second calculation unit calculates the correction value for the amount of fuel injection at the amount of air different from the amount of air detected when a plurality of second correction values are calculated, based on the plurality of second correction values. The third calculation unit calculates the correction value for the amount of fuel injection at the amount of air different from the amount of air detected when a plurality of third correction values are calculated, based on the plurality of third correction values.

According to the present invention, for example, when the first correction value in the first injection region is calculated in two learning regions, that is, when two first correction values are calculated, two points are connected by a straight line, so that the correction value at the amount of air between the two points is calculated (interpolated). The correction value is interpolated similarly in the second and third injection regions. Accordingly, the correction value at the amount of air different from the detected amount of air can be calculated for each injection region, and an appropriate correction value in accordance with an amount of intake air can be calculated. A fuel injection portion is controlled such that the fuel injection amount is corrected based on such a correction value. Consequently, an amount of fuel injection can appropriately be corrected.

Preferably, the third control unit controls the fuel injection mechanism by including at least a first ratio and a second ratio in a ratio between an amount of injection from the first fuel injection mechanism and an amount of injection from the second fuel injection mechanism. The third calculation unit provides an identical correction value when the ratio of injection amount is set to the first ratio and when the ratio of injection amount is set to the second ratio.

According to the present invention, in the third injection region, that is, when the fuel is injected into both of the cylinder and the intake manifold, the same correction value is calculated for a case in which the injection amount ratio is set to the first ratio and a case in which the injection amount ratio is set to the second ratio. When the amount of air is the same (in the same learning region), it is less frequent even in the third injection region that the fuel is injected at different injection amount ratios. Therefore, an occasion to interpolate the correction value corresponding to the ratio of injection amount is less likely. The same correction value is thus calculated regardless of the ratio of injection amount. Hence, the amount of fuel injection can appropriately be corrected.

Preferably, the first control unit controls the fuel injection mechanism so that the amount of injection from the first fuel injection mechanism is corrected based on the correction value calculated by the first calculation unit. The second control unit controls the fuel injection mechanism so that the amount of injection from the second fuel injection mechanism is corrected based on the correction value calculated by the second calculation unit. The third control unit controls the fuel injection mechanism so that at least one of the amount of injection from the first fuel injection mechanism and the amount of injection from the second fuel injection mechanism is corrected based on the correction value calculated by the third calculation unit.

According to the present invention, the fuel injection portion is controlled such that the amount of fuel injection is corrected based on the correction value appropriately calculated in accordance with the intake air amount. Therefore, the amount of fuel injection can appropriately be corrected.

A control device for an internal combustion engine according to another aspect of the present invention controls an internal combustion engine including a first fuel injection mechanism injecting fuel into a cylinder and a second fuel injection mechanism injecting fuel into an intake manifold. The control device includes: a control unit controlling the fuel injection mechanism so that the fuel is injected from the first fuel injection mechanism and the second fuel injection mechanism in a predetermined injection region; a detection unit detecting an amount of air suctioned into the internal combustion engine; a correction value calculation unit calculating a correction value for an amount of fuel injection in a predetermined injection region, for a plurality of learning regions obtained as a result of division corresponding to the amount of air; and a calculation unit calculating a correction value for an amount of fuel injection at an amount of air different from the amount of air detected when the correction value is calculated, based on the correction value.

According to the present invention, the correction value for the amount of fuel injection in the predetermined injection region is calculated for the plurality of learning regions obtained as a result of division corresponding to the amount of air. The correction value at the amount of air different from the amount of air detected at the time of calculation of the correction value is calculated by the calculation unit, based on the correction value calculated in the predetermined injection amount region. For example, when the correction value in the predetermined injection region is calculated in two learning regions, that is, when two correction values are calculated, two points are connected by a straight line, so that the correction value at the amount of air between the two points is calculated (interpolated). Accordingly, the correction value at the amount of air different from the detected amount of air can be calculated, and an appropriate correction value in accordance with an amount of intake air can be calculated. A fuel injection portion is controlled such that the fuel injection amount is corrected based on such a correction value. Consequently, a control device for an internal combustion engine capable of appropriately correcting an amount of fuel injection can be provided.

Preferably, the calculation unit calculates the correction value for the amount of fuel injection at the amount of air different from the amount of air detected when a plurality of correction values are calculated, based on the plurality of correction values.

According to the present invention, for example, when the correction value in the predetermined injection region is calculated in two learning regions, that is, when two correction values are calculated, two points are connected by a straight line, so that the correction value at the amount of air between the two points is calculated (interpolated). Accordingly, the correction value at the amount of air different from the detected amount of air can be calculated, and an appropriate correction value in accordance with an amount of intake air can be calculated. A fuel injection portion is controlled such that the fuel injection amount is corrected based on such a correction value. Consequently, a control device for an internal combustion engine capable of appropriately correcting an amount of fuel injection can be provided.

Preferably, the control unit controls the fuel injection mechanism by including at least a first ratio and a second ratio in a ratio between an amount of injection from the first fuel injection mechanism and an amount of injection from the second fuel injection mechanism. The calculation unit provides an identical correction value when the ratio of injection amount is set to the first ratio and when the ratio of injection amount is set to the second ratio.

According to the present invention, when the fuel is injected into both of the cylinder and the intake manifold, the same correction value is calculated for a case in which the injection amount ratio is set to the first ratio and a case in which the injection amount ratio is set to the second ratio. Here, when the amount of air is the same (in the same learning region), it is less frequent that the fuel is injected at different injection amount ratios. Therefore, an occasion to interpolate the correction value corresponding to the ratio of injection amount is less likely. The same correction value is thus calculated regardless of the ratio of injection amount. Hence, the amount of fuel injection can appropriately be corrected.

Preferably, the control unit controls the fuel injection mechanism so that at least one of the amount of injection from the first fuel injection mechanism and the amount of injection from the second fuel injection mechanism is corrected based on the correction value calculated by the calculation unit.

According to the present invention, the fuel injection portion is controlled such that the amount of fuel injection is corrected based on the correction value appropriately calculated in accordance with the intake air amount. Therefore, the amount of fuel injection can appropriately be corrected.

A control device for an internal combustion engine according to yet another aspect of the present invention controls an internal combustion engine including a first fuel injection mechanism injecting fuel into a cylinder and a second fuel injection mechanism injecting fuel into an intake manifold. The control device includes: a first control unit controlling the fuel injection mechanism so that the fuel is injected solely from the first fuel injection mechanism in a first injection region; a second control unit controlling the fuel injection mechanism so that the fuel is injected solely from the second fuel injection mechanism in a second injection region; a third control unit controlling the fuel injection mechanism so that the fuel is injected from the first fuel injection mechanism and the second fuel injection mechanism in a third injection region; a detection unit detecting an amount of air suctioned into the internal combustion engine; a first calculation unit calculating a first correction value for an amount of fuel injection in the first injection region, for at least one of a plurality of learning regions obtained as a result of division corresponding to the amount of air; a second calculation unit calculating a second correction value for an amount of fuel injection in the second injection region, for at least one of the plurality of learning regions; a third calculation unit calculating a third correction value for an amount of fuel injection in the third injection region, for at least one of the plurality of learning regions; a first setting unit setting a first correction value in other learning region based on the first correction value calculated by the first calculation unit; a second setting unit setting a second correction value in other learning region based on the second correction value calculated by the second calculation unit; and a third setting unit setting a third correction value in other learning region based on the third correction value calculated by the third calculation unit.

According to the present invention, each calculation unit calculates the correction value for the amount of fuel injection in each injection region, for at least one of the plurality of learning regions obtained as a result of division corresponding to the amount of air. Each setting unit sets the correction value in other learning region based on each correction value calculated by each calculation unit. For example, the first correction value in other learning region within the first injection region is set such that deviation from the first correction value in at least one of the learning regions in the first injection region is within a predetermined range or it is set equal to the first correction value therein. The correction value is set similarly in the second and third injection regions. The correction value in the learning region in which an occasion to calculate the correction value has not yet been obtained can thus be obtained. Consequently, a control device for an internal combustion engine capable of appropriately correcting an amount of fuel injection can be provided.

Preferably, the first setting unit sets the first correction value in other learning region such that deviation from the first correction value calculated by the first calculation unit is within a predetermined range. The second setting unit sets the second correction value in other learning region such that deviation from the second correction value calculated by the second calculation unit is within a predetermined range. The third setting unit sets the third correction value in other learning region such that deviation from the third correction value calculated by the third calculation unit is within a predetermined range.

According to the present invention, the first correction value in other learning region is set such that deviation from the first correction value in at least one of the learning regions in the first injection region is within a predetermined range. The correction value is set similarly in the second and third injection regions. The correction value in the learning region in which an occasion to calculate the correction value has not yet been obtained can thus be obtained.

Preferably, the first setting unit sets the first correction value in other learning region to be equal to the first correction value calculated by the first calculation unit. The second setting unit sets the second correction value in other learning region to be equal to the second correction value calculated by the second calculation unit. The third setting unit sets the third correction value in other learning region to be equal to the third correction value calculated by the third calculation unit.

According to the present invention, the first correction value in other learning region is set equal to the first correction value in at least one of the learning regions in the first injection region. The correction value is set similarly in the second and third injection regions. The correction value in the learning region in which an occasion to calculate the correction value has not yet been obtained can thus be obtained.

A control device for an internal combustion engine according to yet another aspect of the present invention controls an internal combustion engine including a first fuel injection mechanism injecting fuel into a cylinder and a second fuel injection mechanism injecting fuel into an intake manifold. The control device includes: a control unit controlling the fuel injection mechanism so that the fuel is injected from the first fuel injection mechanism and the second fuel injection mechanism in a predetermined injection region; a detection unit detecting an amount of air suctioned into the internal combustion engine; a calculation unit calculating a correction value for an amount of fuel injection in a predetermined injection region, for at least one of a plurality of learning regions obtained as a result of division corresponding to the amount of air; and a setting unit setting a correction value in other learning region based on the correction value calculated by the calculation unit.

According to the present invention, the calculation unit calculates the correction value for the amount of fuel injection in the predetermined injection region, for at least one of the plurality of learning regions obtained as a result of division corresponding to the amount of air. The setting unit calculates the correction value in other learning region based on the correction value calculated by the calculation unit. For example, the correction value in other learning region is set such that deviation from the correction value in at least one of the learning regions in the predetermined injection region is within a predetermined range or it is set equal to the correction value therein. The correction value in the learning region in which an occasion to calculate the correction value has not yet been obtained can thus be obtained. Consequently, a control device for an internal combustion engine capable of appropriately correcting an amount of fuel injection can be provided.

Preferably, the setting unit sets the correction value in other learning region such that deviation from the correction value calculated by the calculation unit is within a predetermined range.

According to the present invention, the correction value in other learning region is set such that deviation from the correction value in at least one of the learning regions in the predetermined injection region is within a predetermined range. The correction value in the learning region in which an occasion to calculate the correction value has not yet been obtained can thus be obtained.

Preferably, the setting unit sets the correction value in other learning region to be equal to the correction value calculated by the calculation unit.

According to the present invention, the correction value in other learning region is set equal to the correction value in at least one of the learning regions in the predetermined injection region. The correction value in the learning region in which an occasion to calculate the correction value has not yet been obtained can thus be obtained.

Preferably, the first fuel injection mechanism is an in-cylinder injector, and the second fuel injection mechanism is an intake manifold injector.

According to the present invention, in the internal combustion engine in which the in-cylinder injector serving as the first fuel injection portion and the intake manifold injector serving as the second fuel injection portion are separately provided to inject the fuel at a ratio set therebetween, the amount of fuel injection can appropriately be corrected.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
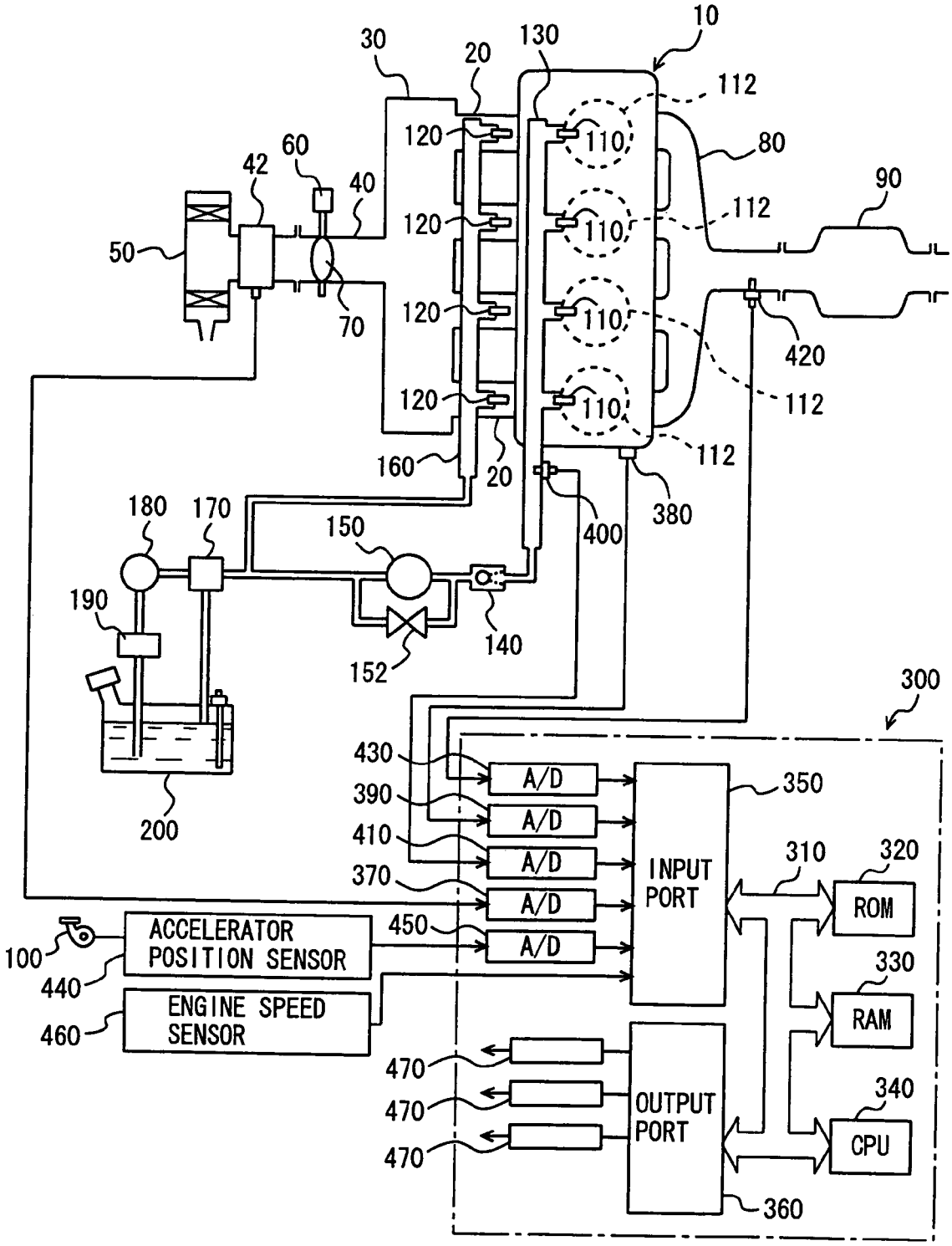
FIG. 1 is a schematic configuration diagram of an engine system controlled by a control device according to a first embodiment of the present invention.

An embodiment of the present invention will be described hereinafter with reference to the drawings. The same elements have the same reference characters allotted. Their label and function are also identical. Therefore, detailed description thereof will not be repeated.

First Embodiment

FIG. 1 schematically shows a configuration of an engine system controlled by an engine ECU (Electronic Control Unit) that is a control device of an internal combustion engine according to a first embodiment of the present invention. Although an in-line 4-cylinder gasoline engine is shown in FIG. 1, application of the present invention is not restricted to the engine shown, and the present invention is applicable to various types of engines such as a V-type 6-cylinder engine, a V-type 8-cylinder engine and the like.

As shown in FIG. 1, an engine 10 includes four cylinders 112, which are connected via corresponding intake manifolds 20 to a common surge tank 30. Surge tank 30 is connected via an intake duct 40 to an air cleaner 50. In intake duct 40, an airflow meter 42 and a throttle valve 70, which is driven by an electric motor 60, are disposed. Throttle valve 70 has its opening position controlled based on an output signal of an engine ECU 300, independently of an accelerator pedal 100. Cylinders 112 are connected to a common exhaust manifold 80, which is in turn connected to a three-way catalytic converter 90.

For each cylinder 112, an in-cylinder injector 110 for injecting fuel into the cylinder and an intake manifold injector 120 for injecting fuel into an intake port and/or an intake manifold are provided. These injectors 110, 120 are controlled based on output signals of engine ECU 300. In-cylinder injectors 110 are connected to a common fuel delivery pipe 130. Fuel delivery pipe 130 is connected to a high-pressure fuel pump 150 of an engine driven type via a check valve 140 that allows flow toward fuel delivery pipe 130. In the present embodiment, description will be made as to the internal combustion engine having two injectors provided separately, although the present invention is not limited thereto. For example, the internal combustion engine may have a single injector capable of performing both in-cylinder injection and intake manifold injection.

As shown in FIG. 1, the discharge side of high-pressure fuel pump 150 is connected to the intake side of high-pressure fuel pump 150 via an electromagnetic spill valve 152. It is configured such that the amount of the fuel supplied from high-pressure fuel pump 150 to fuel delivery pipe 130 increases as the degree of opening of electromagnetic spill valve 152 is smaller, and that fuel supply from high-pressure fuel pump 150 to fuel delivery pipe 130 is stopped when electromagnetic spill valve 152 is fully opened. Electromagnetic spill valve 152 is controlled based on an output signal of engine ECU 300.

Meanwhile, intake manifold injectors 120 are connected to a common fuel delivery pipe 160 on the low-pressure side. Fuel delivery pipe 160 and high-pressure fuel pump 150 are connected to a low-pressure fuel pump 180 of an electric motor driven type via a common fuel pressure regulator 170. Further, low-pressure fuel pump 180 is connected to a fuel tank 200 via a fuel filter 190. Fuel pressure regulator 170 is configured to return a part of the fuel discharged from low-pressure fuel pump 180 to fuel tank 200 when the pressure of the fuel discharged from low-pressure fuel pump 180 becomes higher than a preset fuel pressure. This prevents the pressure of the fuel supplied to intake manifold injectors 120 as well as the pressure of the fuel supplied to high-pressure fuel pump 150 from becoming higher than the preset fuel pressure.

Engine ECU 300 is configured with a digital computer, which includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air amount, and the output voltage of airflow meter 42 is input via an A/D converter 370 to input port 350. A coolant temperature sensor 380 is attached to engine 10, which generates an output voltage proportional to an engine coolant temperature. The output voltage of coolant temperature sensor 380 is input via an A/D converter 390 to input port 350.

A fuel pressure sensor 400 is attached to fuel delivery pipe 130, which generates an output voltage proportional to a fuel pressure in fuel delivery pipe 130. The output voltage of fuel pressure sensor 400 is input via an A/D converter 410 to input port 350. An air-fuel ratio sensor 420 is attached to exhaust manifold 80 located upstream of three-way catalytic converter 90. Air-fuel ratio sensor 420 generates an output voltage proportional to an oxygen concentration in the exhaust gas, and the output voltage of air-fuel ratio sensor 420 is input via an A/D converter 430 to input port 350.

Air-fuel ratio sensor 420 in the engine system of the present embodiment is a full-range air-fuel ratio sensor (linear air-fuel ratio sensor) that generates an output voltage proportional to an air-fuel ratio of the air-fuel mixture burned in engine 10. As air-fuel ratio sensor 420, an $O_2$ sensor may be used which detects, in an on/off manner, whether the air-fuel ratio of the mixture burned in engine 10 is rich or lean with respect to a stoichiometric air-fuel ratio.

In the present embodiment, engine ECU 300 calculates a feedback correction amount for the total fuel injection amount based on the output voltage of air-fuel ratio sensor 420. In addition, when a predetermined learning condition is satisfied, engine ECU 300 calculates a learn value of the feedback correction amount (a value representing constant deviation with regard to the amount of fuel injection). Calculation of the feedback correction amount and the learn value thereof are performed in a learning region predetermined by using an intake air amount as a parameter. The learning region will be described in detail later.

As to a method of calculating the feedback correction amount and the learn value thereof, a technique commonly used in the internal combustion engine including one injector for each cylinder is used. Therefore, detailed description thereof will not be repeated.

Accelerator pedal 100 is connected to an accelerator position sensor 440 that generates an output voltage proportional to a degree of press-down of accelerator pedal 100. The output voltage of accelerator position sensor 440 is input via an A/D converter 450 to input port 350. An engine speed sensor 460 generating an output pulse representing the engine speed is connected to input port 350. ROM 320 of engine ECU 300 prestores, in the form of a map, values of fuel injection amount that are set corresponding to operation states based on the engine load factor and the engine speed obtained by the above-described accelerator position sensor 440 and engine speed sensor 460, respectively, and the correction values based on the engine coolant temperature.

Figure 2:
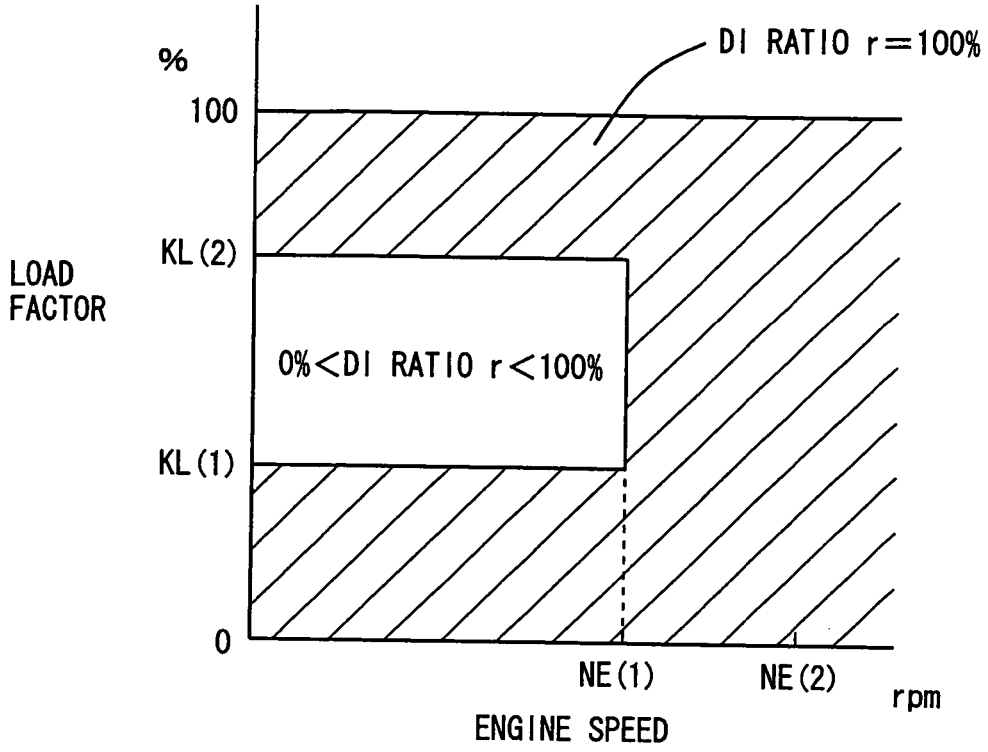
FIGS. 2 and 3 illustrate DI ratio maps in a warm state and a cold state respectively, stored in an engine ECU serving as the control device according to the first embodiment of the present invention.
Figure 3:
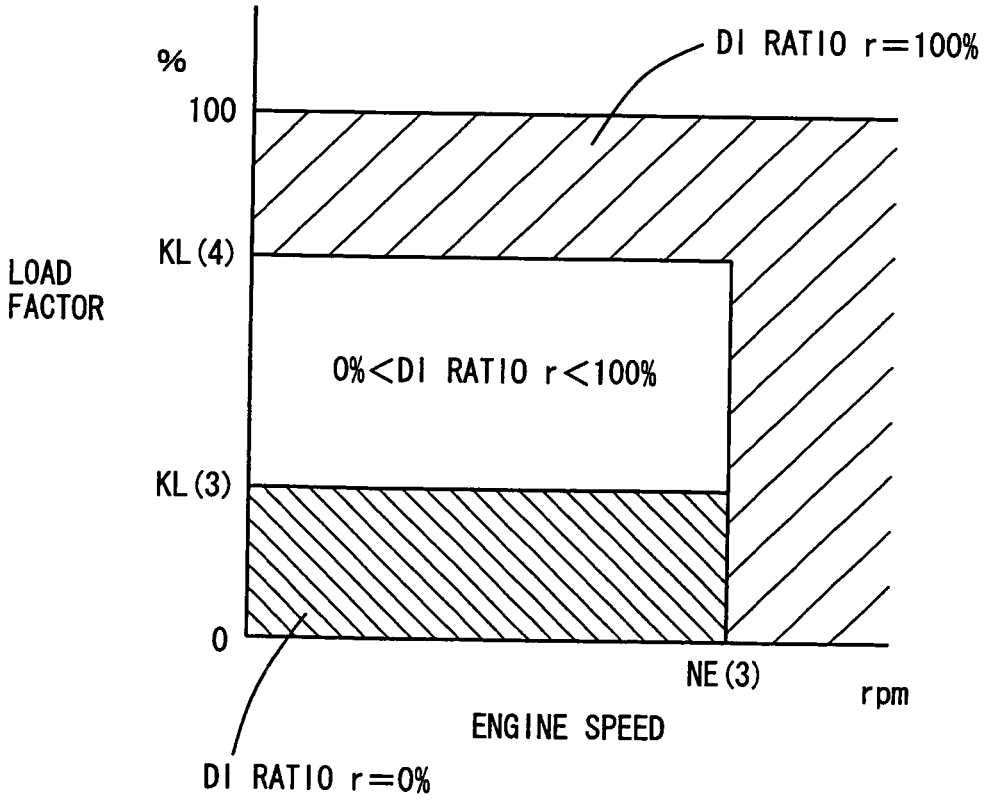

Referring to FIGS. 2 and 3, maps each indicating a fuel injection ratio between in-cylinder injector 10 and intake manifold injector 120 (hereinafter, also referred to as a DI ratio (r)), identified as information associated with an operation state of engine 10, will now be described. The maps are stored in ROM 320 of engine ECU 300. FIG. 2 is the map for a warm state of engine 10, and FIG. 3 is the map for a cold state of engine 10.

In the maps illustrated in FIGS. 2 and 3, with the horizontal axis representing an engine speed of engine 10 and the vertical axis representing a load factor, the fuel injection ratio of in-cylinder injector 110, or the DI ratio r, is expressed in percentage.

As shown in FIGS. 2 and 3, the DI ratio r is set for each operation region that is determined by the engine speed and the load factor of engine 10. "DI RATIO r=100%" represents the region where fuel injection is carried out using only in-cylinder injector 110, and "DI RATIO r=0%" represents the region where fuel injection is carried out using only intake manifold injector 120. "DI RATIO r≠0%", "DI RATIO r≠100%" and "0%<DI RATIO r<100%" each represent the region where fuel injection is carried out using both in-cylinder injector 110 and intake manifold injector 120. Generally, in-cylinder injector 110 contributes to an increase of output performance, while intake manifold injector 120 contributes to uniformity of the air-fuel mixture. These two kinds of injectors having different characteristics are appropriately selected depending on the engine speed and the load factor of engine 10, so that only homogeneous combustion is conducted in the normal operation state of engine 10 (other than the abnormal operation state such as a catalyst warm-up state during idling).

Further, as shown in FIGS. 2 and 3, the fuel injection ratio between in-cylinder injector 110 and intake manifold injector 120, or the DI ratio r, is defined individually in the map for the warm state and in the map for the cold state of the engine. The maps are configured to indicate different control regions of in-cylinder injector 110 and intake manifold injector 120 as the temperature of engine 10 changes. When the temperature of engine 10 detected is equal to or higher than a predetermined temperature threshold value, the map for the warm state shown in FIG. 2 is selected; otherwise, the map for the cold state shown in FIG. 3 is selected. One or both of in-cylinder injector 110 and intake manifold injector 120 are controlled based on the selected map and according to the engine speed and the load factor of engine 10.

In the present embodiment, the amount of fuel injection from in-cylinder injector 110 and the amount of fuel injection from intake manifold injector 120 are determined based on DI ratio r such that the total fuel injection amount attains the desired injection amount.

The engine speed and the load factor of engine 10 set in FIGS. 2 and 3 will now be described. In FIG. 2, NE(1) is set to 2500 rpm to 2700 rpm, KL(1) is set to 30% to 50%, and KL(2) is set to 60% to 90%. In FIG. 3, NE(3) is set to 2900 rpm to 3100 rpm. That is, NE(1)<NE(3). NE(2) in FIG. 2 as well as KL(3) and KL(4) in FIG. 3 are also set as appropriate.

When comparing FIG. 2 and FIG. 3, NE(3) of the map for the cold state shown in FIG. 3 is greater than NE(1) of the map for the warm state shown in FIG. 2. This shows that, as the temperature of engine 10 is lower, the control region of intake manifold injector 120 is expanded to include the region of higher engine speed. That is, in the case where engine 10 is cold, deposits are unlikely to accumulate in the injection hole of in-cylinder injector 110 (even if the fuel is not injected from in-cylinder injector 110). Thus, the region where the fuel injection is to be carried out using intake manifold injector 120 can be expanded, to thereby improve homogeneity.

When comparing FIG. 2 and FIG. 3, "DI RATIO r=100%" in the region where the engine speed of engine 10 is NE(1) or higher in the map for the warm state, and in the region where the engine speed is NE(3) or higher in the map for the cold state. In terms of load factor, "DI RATIO r=100%" in the region where the load factor is KL(2) or greater in the map for the warm state, and in the region where the load factor is KL(4) or greater in the map for the cold state. This means that in-cylinder injector 110 solely is used in the region of a predetermined high engine speed, and in the region of a predetermined high engine load. That is, in the high speed region or the high load region, even if fuel injection is carried out using only in-cylinder injector 110, the engine speed and the load of engine 10 are high, ensuring a sufficient intake air amount, so that it is readily possible to obtain a homogeneous air-fuel mixture even using only in-cylinder injector 110. In this manner, the fuel injected from in-cylinder injector 110 is atomized within the combustion chamber involving latent heat of vaporization (or, absorbing heat from the combustion chamber). Thus, the temperature of the air-fuel mixture is decreased at the compression end, whereby antiknock performance is improved. Further, since the temperature within the combustion chamber is decreased, intake efficiency improves, leading to high power output.

In the map for the warm state in FIG. 2, fuel injection is carried out using only in-cylinder injector 110 when the load factor is KL(1) or less. This shows that in-cylinder injector 110 alone is used in a predetermined low load region when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, whereby accumulation of deposits is prevented. Further, clogging of in-cylinder injector 110 may be prevented while ensuring the minimum fuel injection amount thereof. Thus, in-cylinder injector 110 alone is used in the relevant region.

When comparing FIG. 2 and FIG. 3, there is a region of "DI RATIO r=0%" only in the map for the cold state in FIG. 3. This shows that fuel injection is carried out using only intake manifold injector 120 in a predetermined low load region (KL(3) or less) when the temperature of engine 10 is low. When engine 10 is cold and low in load and the intake air amount is small, atomization of the fuel is unlikely to occur. In such a region, it is difficult to ensure favorable combustion with the fuel injection from in-cylinder injector 110. Further, particularly in the low-load and low-speed region, high output using in-cylinder injector 110 is unnecessary. Accordingly, fuel injection is carried out using only intake manifold injector 120, rather than in-cylinder injector 110, in the relevant region.

Further, in an operation other than the normal operation, or in the catalyst warm-up state during idling of engine 10 (abnormal operation state), in-cylinder injector 110 is controlled to carry out stratified charge combustion. By causing the stratified charge combustion only during the catalyst warm-up operation, warming up of the catalyst is promoted, and exhaust emission is thus improved.

Figure 4:
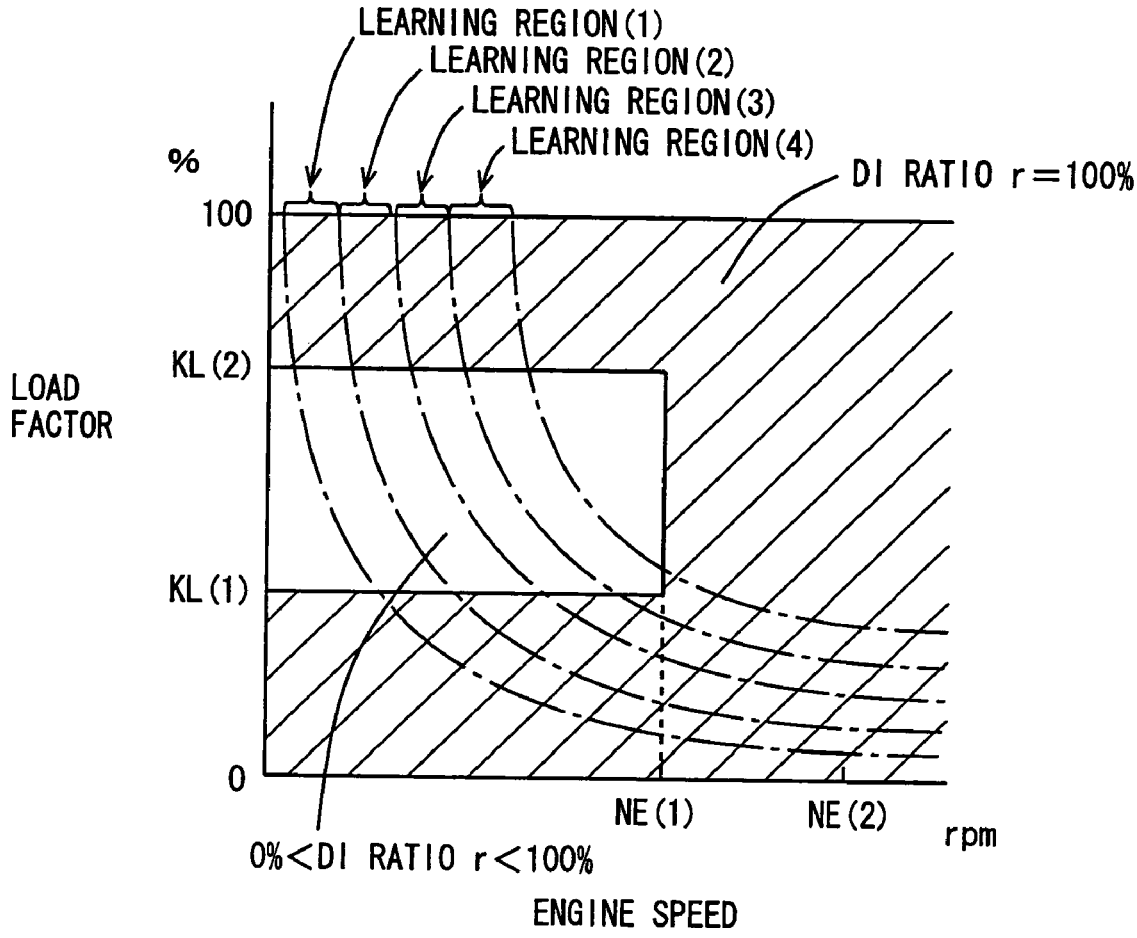
FIG. 4 is a first diagram showing a learning region of an amount of fuel injection stored in the engine ECU serving as the control device according to the first embodiment of the present invention.

A learning region where a feedback correction amount and a learn value thereof are calculated will now be described with reference to FIGS. 4 and 5. FIG. 4 shows a learning region in the map for the warm state, while FIG. 5 shows a learning region in the map for the cold state.

Figure 5:
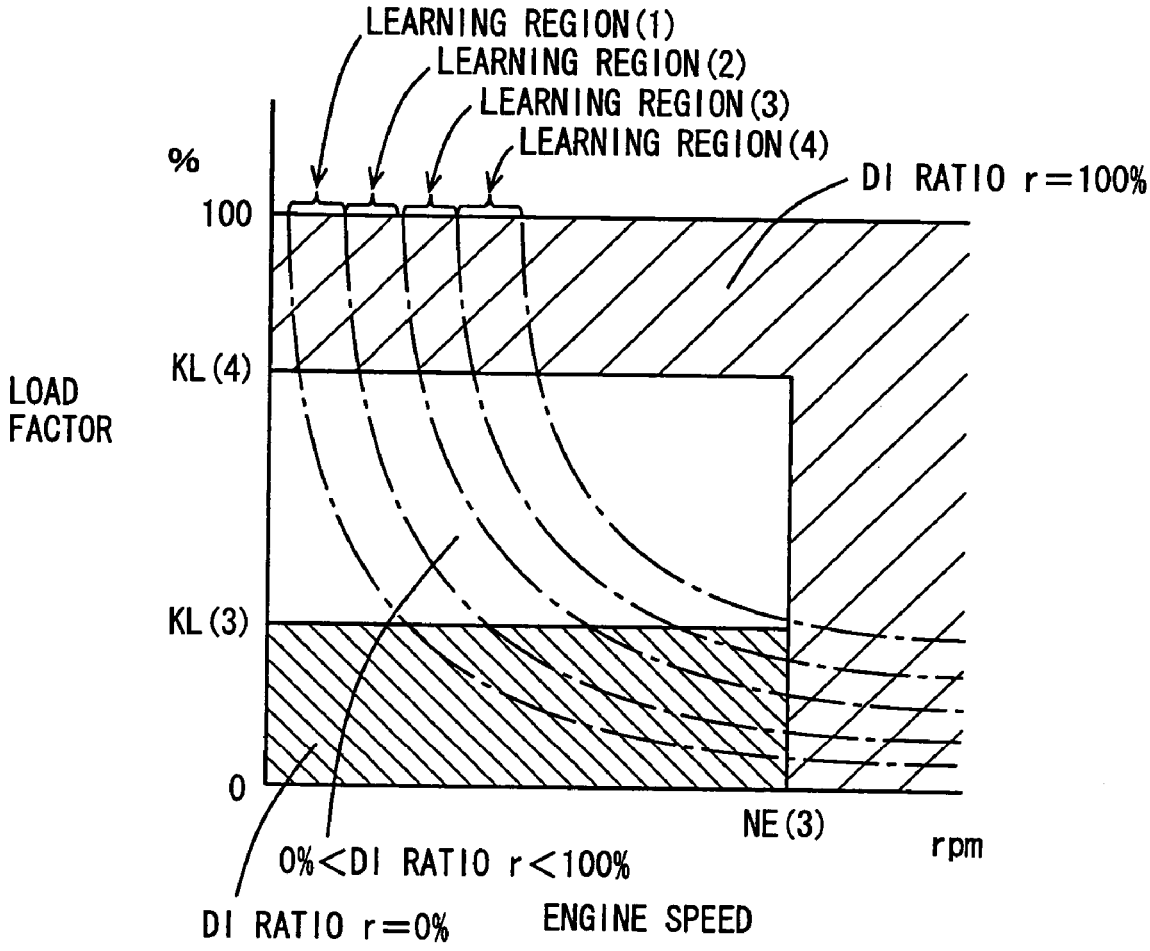
FIG. 5 is a second diagram showing a learning region of an amount of fuel injection stored in the engine ECU serving as the control device according to the first embodiment of the present invention.

In FIGS. 4 and 5, regions adjacent to each other delimited by chain dotted curves represent the learning regions. The learning region is divided in accordance with an intake air amount. The learning region is set in accordance with the intake air amount because error in output of airflow meter 42 is different depending on the intake air amount.

In the present embodiment, four learning regions, i.e., learning regions (1) to (4), are provided. The intake air amount is largest in learning region (1), second largest in learning region (2), then learning region (3), and smallest in learning region (4). It is noted that the number of learning regions is not limited to four.

In the present embodiment, the feedback correction amount and the learn value thereof are calculated not only for each learning region but also for each injection region (a region where DI ratio r=100%, a region where 0%<DI ratio r<100%, and a region where DI ratio r=0%). In other words, the feedback correction amount and the learn value thereof are calculated for each learning region in each injection region. It is noted that different learning regions may be set for each injection region.

Figure 6:
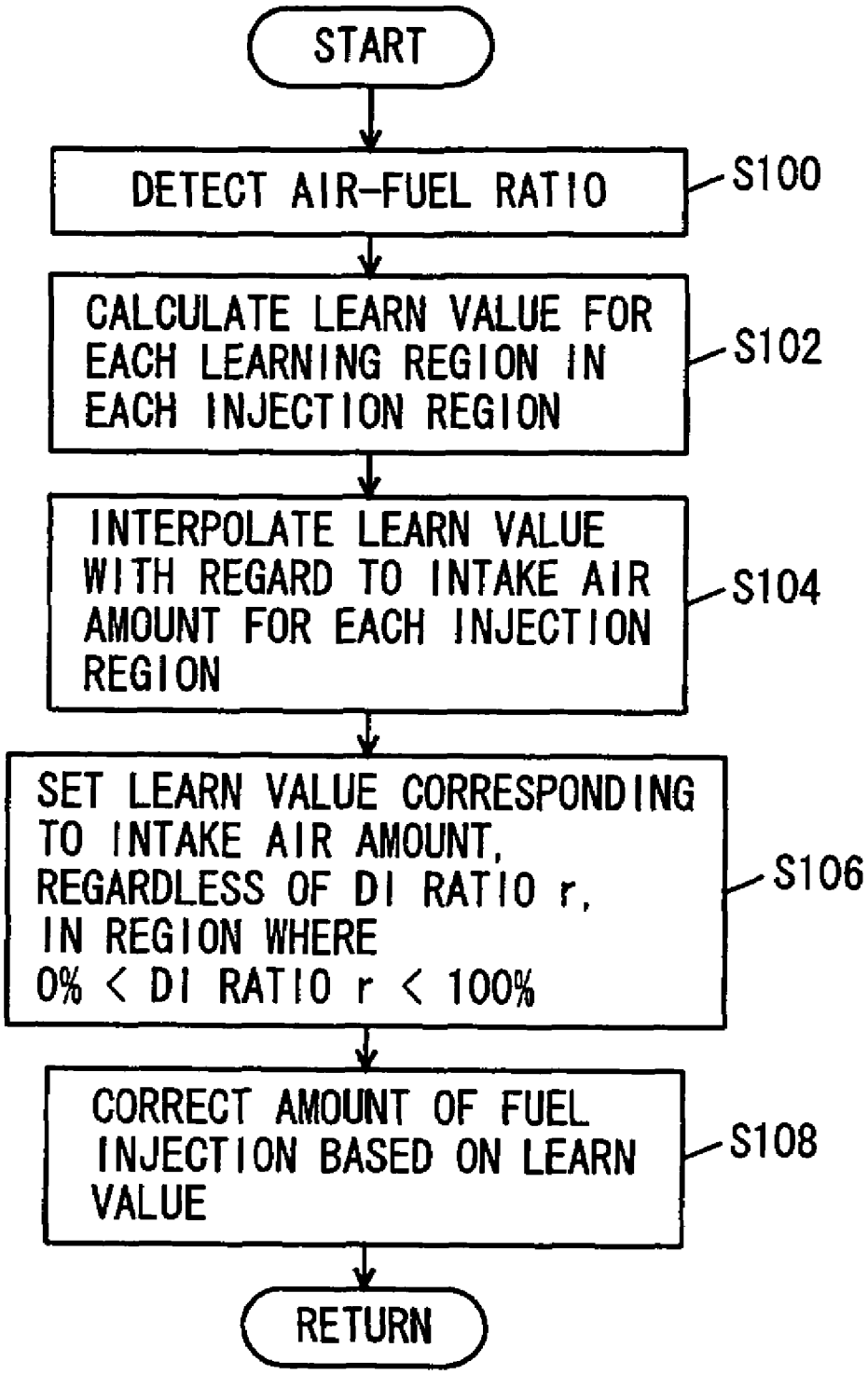
FIG. 6 is a flowchart showing a control configuration of a program executed in the engine ECU serving as the control device according to the first embodiment of the present invention.

A control configuration of a program executed in engine ECU 300 serving as the control device for the internal combustion engine according to the present embodiment will be described with reference to FIG. 6.

At step (hereinafter, step is abbreviated as S) 100, engine ECU 300 detects an air-fuel ratio based on a signal transmitted from air-fuel ratio sensor 420. At S102, engine ECU 300 calculates a learn value for each learning region, in each injection region. The calculated learn value is associated with the intake air amount detected at the time of calculation of the learn value, and stored in RAM 330.

At S104, engine ECU 300 interpolates the learn value with regard to the intake air amount, for each injection region. Engine ECU 300 interpolates the learn value corresponding to the amount of air different from the amount of air detected at the time of calculation of the learn value, by connecting the learn values calculated in adjacent learning regions to each other (linear interpolation).

At S106, engine ECU 300 sets the learn value corresponding to the intake air amount, regardless of DI ratio r, in the region (fuel injection region) where 0%<DI ratio r<100%. That is, if the intake air amount is the same, engine ECU 300 does not perform interpolation of the learn values with regard to DI ratio r but sets the same learn value for different DI ratios r.

At S108, engine ECU 300 corrects the fuel injection amount based on the learn value. In the region where DI ratio r=100%, the amount of fuel injection from in-cylinder injector 110 is corrected based on the learn value in the region where DI ratio r=100%. In the region where DI ratio r=0%, the amount of fuel injection from intake manifold injector 120 is corrected based on the learn value in the region where DI ratio r=0%.

In the region where 0%<DI ratio r<100%, the amount of fuel injection from in-cylinder injector 110 and intake manifold injector 120 is corrected based on the learn value in the region where 0%<DI ratio r<100%. Here, the correction amount for the total injection amount corresponds to the correction amount in accordance with the learn value in the region where 0%<DI ratio r<100%.

In this case, the amount of fuel injection from both of in-cylinder injector 110 and intake manifold injector 120 may be corrected, or alternatively, solely the amount of fuel injection from in-cylinder injector 110 or solely the amount of fuel injection from intake manifold injector 120 may be corrected. In addition, a ratio between the correction amount for in-cylinder injector 110 and the correction amount for intake manifold injector 120 may be determined based on the learn value in the region where DI ratio r=100% or on the learn value in the region where DI ratio r=0%.

An operation of engine ECU 300 serving as the control device for the internal combustion engine according to the present embodiment based on the configuration and the flowchart above will now be described.

During operation of engine 10, the air-fuel ratio is detected based on the signal transmitted from air-fuel ratio sensor 420 (S100), and the learn value of the feedback amount calculated based on the air-fuel ratio is calculated for each learning region, in each injection region (S102).

Figure 7:
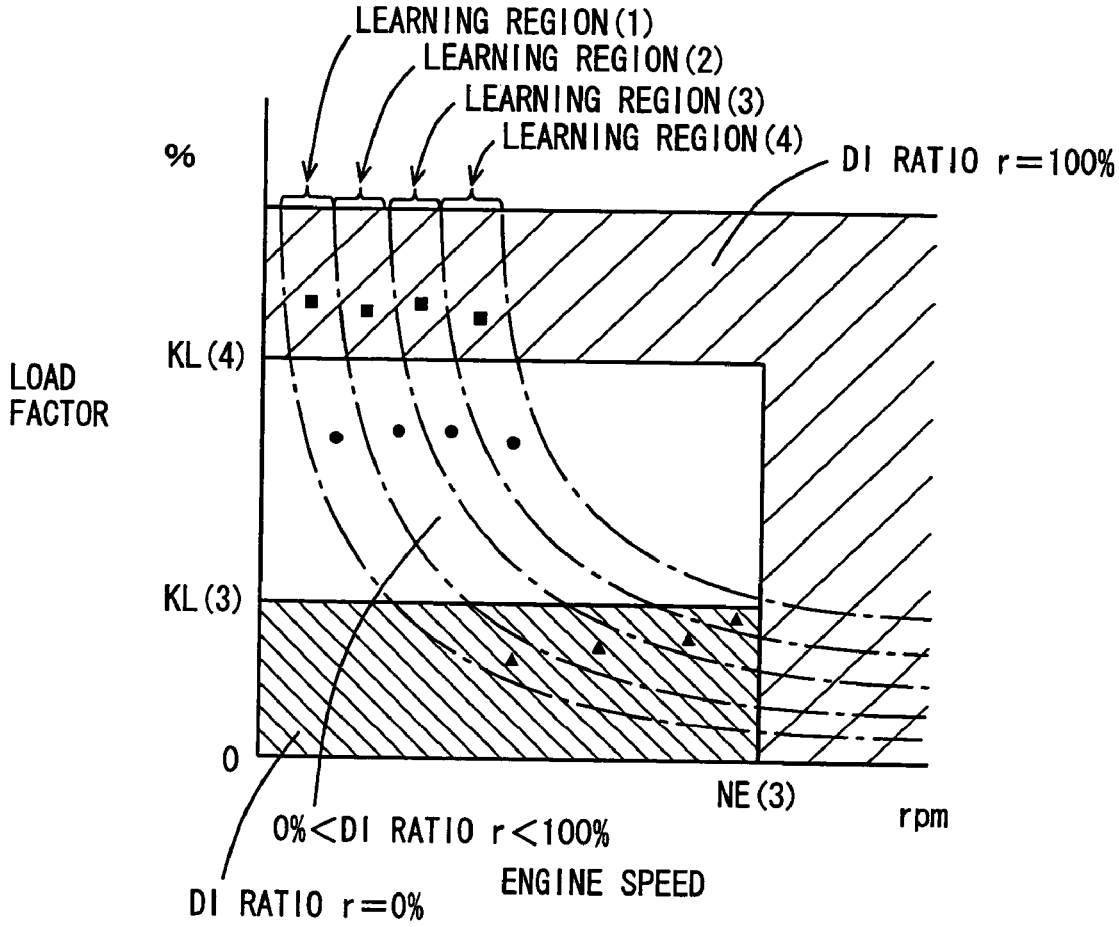
FIG. 7 shows a state in which a learn value has been calculated for each learning region, in each injection region.

Here, it is assumed that one learn value is calculated for each learning region in each injection region, as shown in FIG. 7. In FIG. 7, squares indicate learn values in the region where DI ratio r=100%, circles indicate learn values in the region where 0%<DI ratio r<100%, and triangles indicate learn values in the region where DI ratio r=0%.

As the learn value is calculated only when the predetermined learning condition is satisfied, a certain period of time is necessary for calculating the learn value. Therefore, it is not always the case that an occasion to calculate the learn value with regard to each amount of air in the learning region can be obtained during operation of engine 10.

Figure 8:
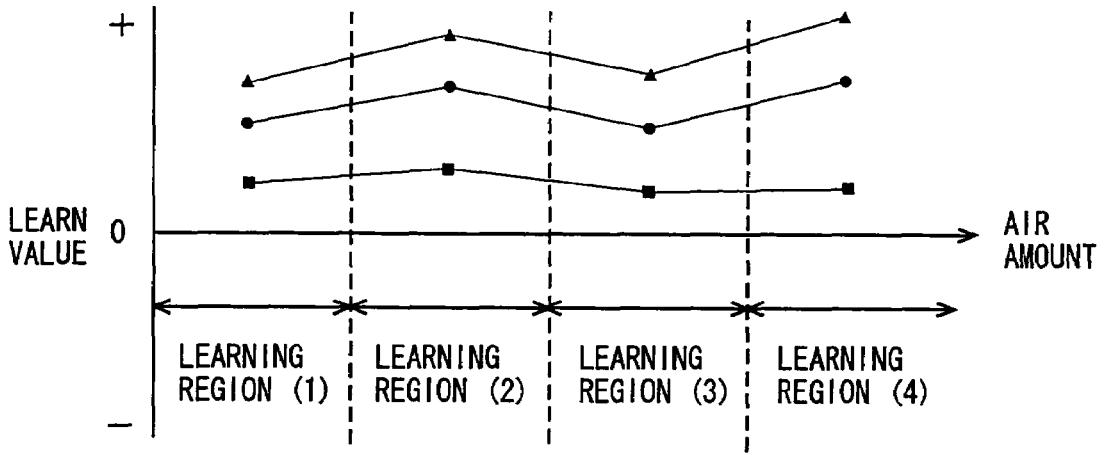
FIG. 8 shows a learn value interpolated corresponding to an amount of air.

Accordingly, as shown in FIG. 8, the learn values in adjacent learning regions are connected by the straight line (linear interpolation), and the learn value corresponding to the amount of air for which the learn value was not calculated is interpolated (S104). In addition, as shown in FIG. 8, interpolation of the learn value is performed for each injection region. In this manner, the learn value corresponding to the amount of air for which an occasion to actually calculate the learn value could not be obtained can be calculated.

During operation of engine 10, the intake air amount significantly varies depending on the load or the engine speed of engine 10. Therefore, as described above, the learn value is calculated in different learning regions (with regard to the intake air amount) in the same injection region, and the calculated learn value is used for interpolation in the region where the learn value was not calculated.

In the region where 0%<DI ratio r<100%, however, there are not many occasions where the fuel is injected at different DI ratios r with the same amount of air (in the same learning region). Therefore, there are not many occasions to obtain a plurality of learn values at different DI ratios r with the same amount of air (in the same learning region). Accordingly, an occasion to interpolate the learn value with regard to DI ratio r is less likely.

Figure 9:
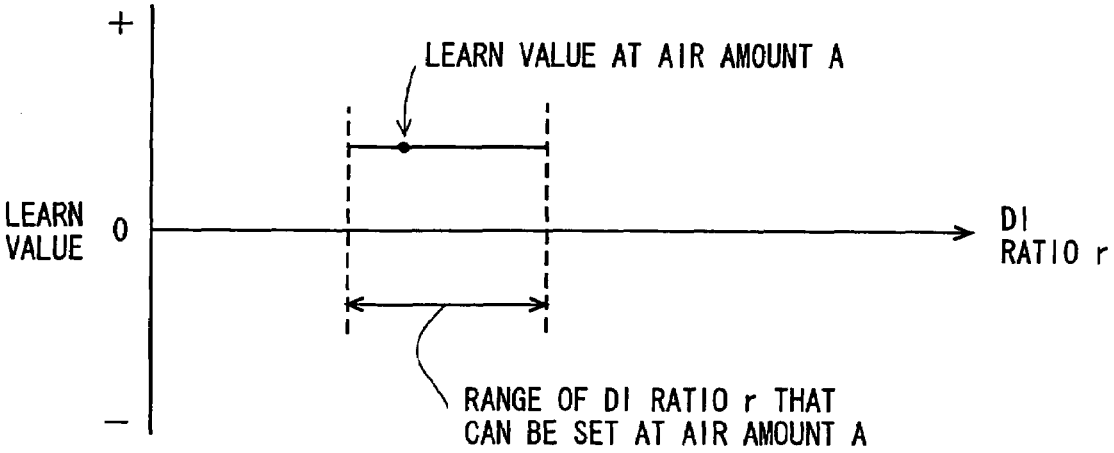
FIG. 9 shows a learn value set with regard to a DI ratio r.

As shown in FIG. 9, in the region where 0%<DI ratio r<100%, interpolation of the learn value with regard to DI ratio r is not performed, but the learn value corresponding to the intake air amount is set regardless of DI ratio r (S106). Namely, as shown in FIG. 9, in a range of DI ratio r that can be set when the amount of air is set to A, the learn value calculated or interpolated corresponding to the amount of air A is used. It is noted that the learn value calculated in correspondence with an arbitrary amount of air may be used in the range of DI ratio r that can be set in an arbitrary learning region. In this manner, the learn value with regard to DI ratio r for which an occasion to actually calculate the learn value could not be obtained can be obtained.

The amount of fuel injection from in-cylinder injector 110 and the amount of fuel injection from intake manifold injector 120 are corrected based on the learn value obtained in the above-described manner (S108). Therefore, the fuel injection amount can appropriately be corrected in the region where an occasion to actually calculate the learn value cannot be obtained.

As described above, according to the engine ECU serving as the control device for the internal combustion engine of the present embodiment, the learn value corresponding to the amount of air for which an occasion to actually calculate the learn value could not be obtained is interpolated with the learn value calculated in each learning region. In addition, interpolation of the learn value with regard to DI ratio r is not performed, and the learn value calculated corresponding to an amount of air is used for different DI ratios. In this manner, the amount of fuel injection can appropriately be corrected also in the region where there are not many occasions to calculate the learn value. Therefore, the air-fuel ratio can be controlled to attain an appropriate state and exhaust emission performance can be improved.

In the present embodiment, the learn value corresponding to the amount of air for which an occasion to calculate the learn value could not be obtained is interpolated based on a plurality of learn values, however, the learn value corresponding to the amount of air for which an occasion to calculate the learn value could not be obtained may be set based on a single learn value.

Second Embodiment

Figure 10:
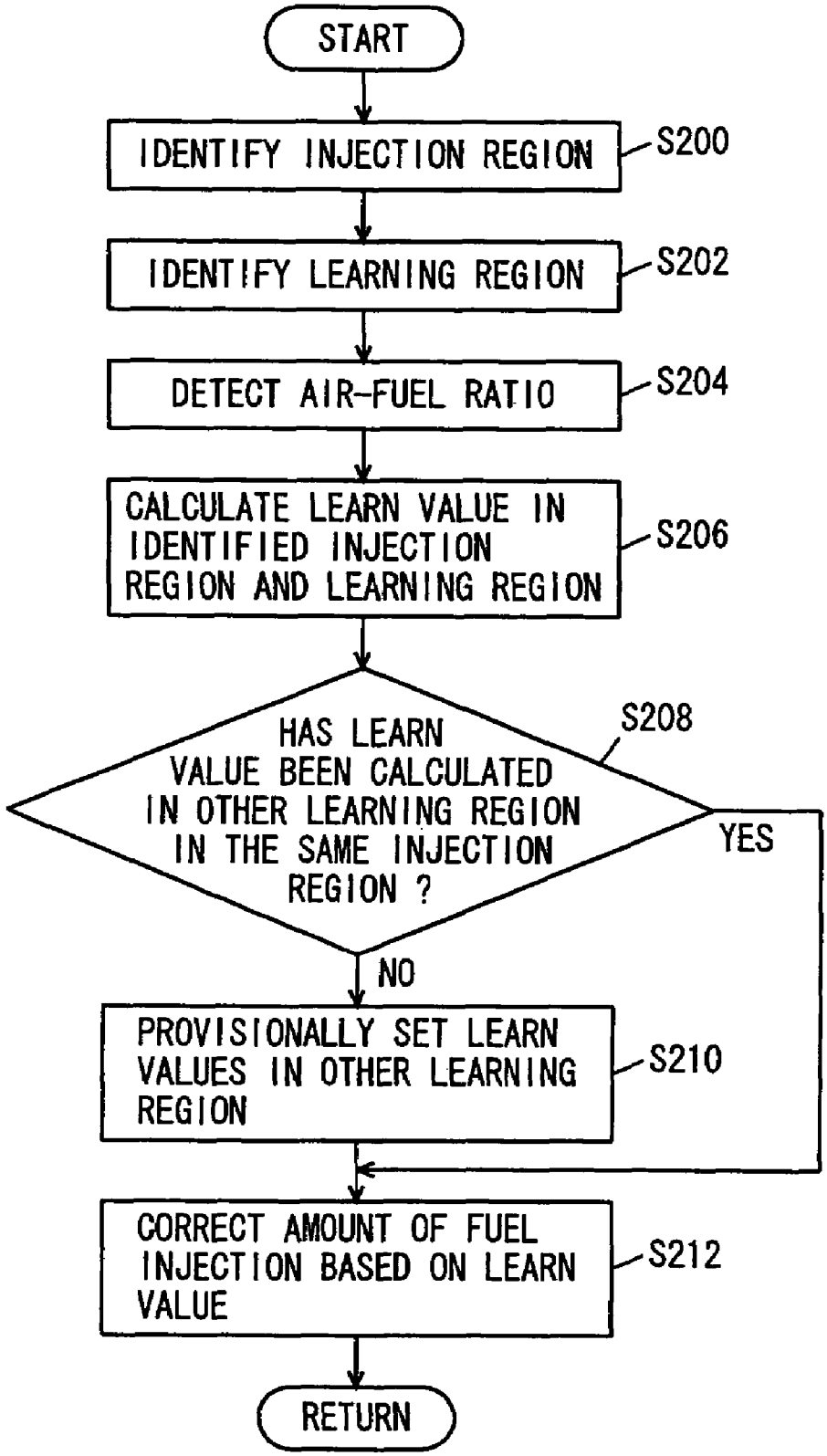
FIG. 10 is a flowchart showing a control configuration of a program executed in the engine ECU serving as the control device according to a second embodiment of the present invention.
Figure 11:
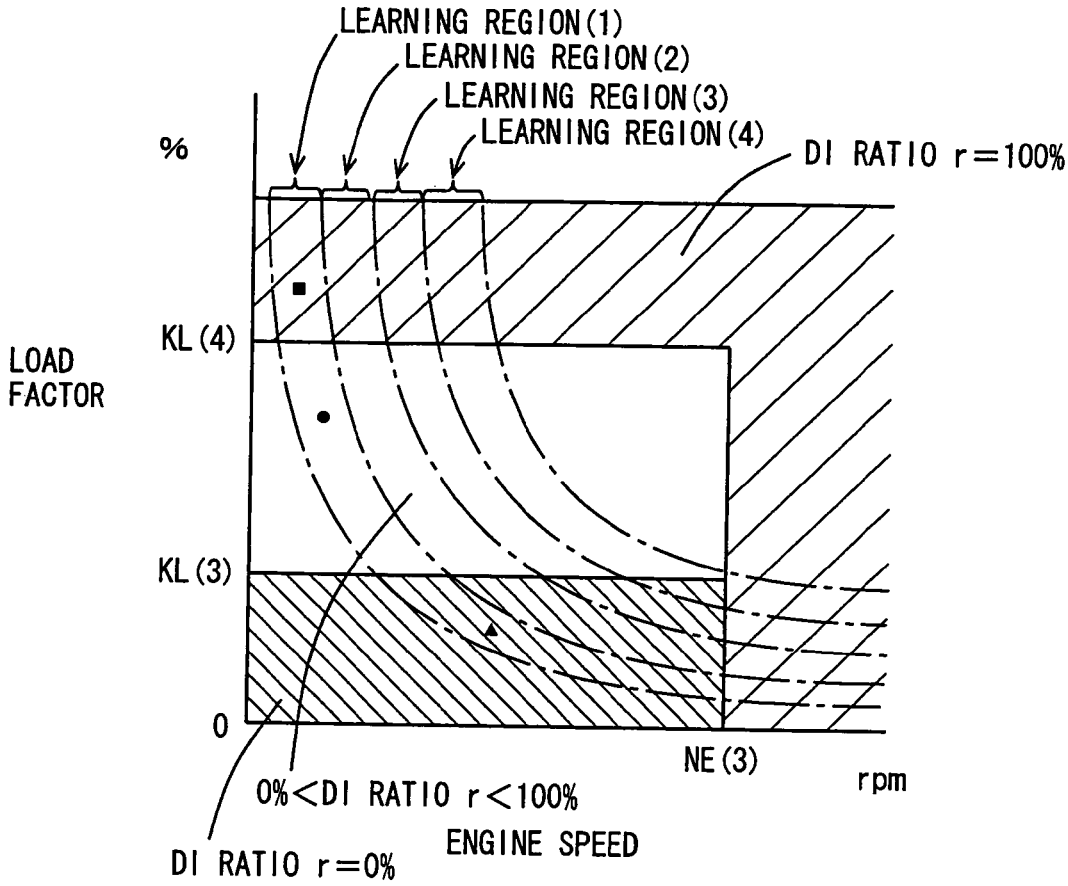
FIG. 11 shows a state in which a learn value has been calculated in each injection region.
Figure 12:
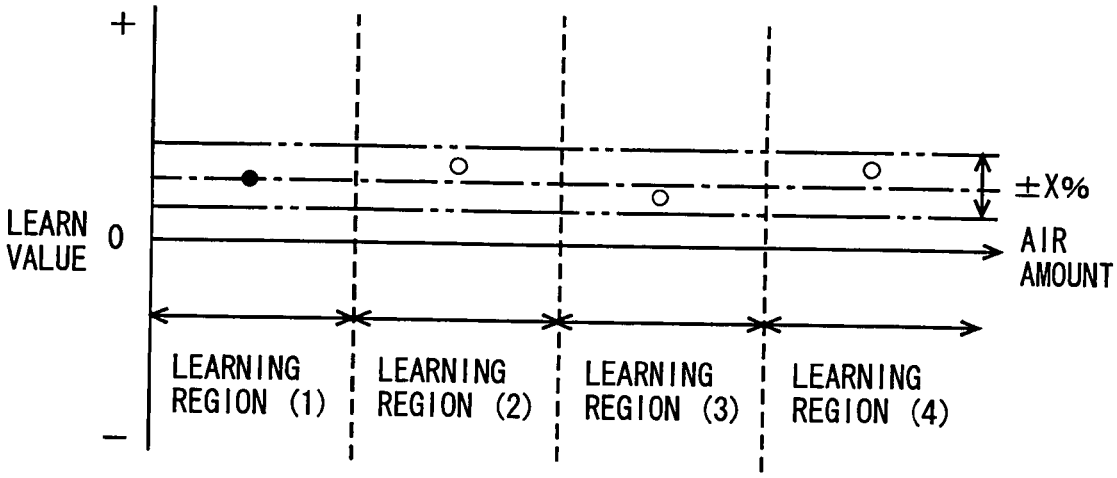
FIG. 12 shows a state in which learn values in learning regions (2) to (4) are set based on a learn value in a learning region (1).

Referring to FIGS. 10 to 12, a second embodiment of the present invention will be described. The present embodiment is different from the first embodiment described previously in that an already calculated learn value is used to set a learn value in other learning region. As the present embodiment is otherwise the same as the first embodiment described previously and functions are also the same, detailed description thereof will not be repeated.

A control configuration of a program executed in engine ECU 300 serving as the control device for the internal combustion engine according to the present embodiment will be described with reference to FIG. 10.

At step (hereinafter, step is abbreviated as S) 100, engine ECU 300 identifies an injection region based on the map showing DI ratio (r) in FIGS. 2 and 3. At S202, engine ECU 300 identifies a learning region based on the intake air amount detected by airflow meter 42.

At S204, engine ECU 300 detects an air-fuel ratio based on a signal transmitted from air-fuel ratio sensor 420. At S206, engine ECU 300 calculates a learn value in the identified injection region and learning region.

At S208, engine ECU 300 identifies whether there is other learning region where the learn value was calculated in the injection region identical to the injection region where the learn value had been calculated. As the learn value is calculated by engine ECU 300 itself, identification as to whether there is other learning region where the learn value was calculated in the injection region is made within engine ECU 300. If there is other learning region where the learn value was calculated in the injection region identical to the injection region where the learn value had been calculated (YES at S208), the process proceeds to S212. Otherwise (NO at S208), the process proceeds to S210.

At S210, engine ECU 300 provisionally sets the learn value for each injection region. Provisional setting of the learn value refers to setting of the learn value in the learning region where the learn value has not yet been calculated, such that the learn value is within a predetermined range (for example, ±X % (X is a constant)) from the calculated learn value. It is noted that the learn value in the learning region where the learn value has not yet been calculated may be set equal to the calculated learn value.

At S212, engine ECU 300 corrects the amount of fuel injection based on the learn value. In the region where DI ratio r=100%, the amount of fuel injection from in-cylinder injector 110 is corrected based on the learn value in the region where DI ratio r=100%. In the region where DI ratio r=0%, the amount of fuel injection from intake manifold injector 120 is corrected based on the learn value in the region where DI ratio r=0%.

In the region where 0%<DI ratio r<100%, the amount of fuel injection from in-cylinder injector 110 and intake manifold injector 120 is corrected based on the learn value in the region where 0%<DI ratio r<100%. Here, the correction amount for the total injection amount corresponds to the correction amount in accordance with the learn value in the region where 0%<DI ratio r<100%.

In this case, the amount of fuel injection from both of in-cylinder injector 110 and intake manifold injector 120 may be corrected, or alternatively, solely the amount of fuel injection from in-cylinder injector 110 or solely the amount of fuel injection from intake manifold injector 120 may be corrected. In addition, a ratio between the correction amount for in-cylinder injector 110 and the correction amount for intake manifold injector 120 may be determined based on the learn value in the region where DI ratio r=100% or on the learn value in the region where DI ratio r=0%.

An operation of engine ECU 300 serving as the control device for the internal combustion engine according to the present embodiment based on the configuration and the flowchart above will now be described.

During operation of engine 10, the injection region is identified based on the map showing DI ratio (r) (S200), and the learning region is identified based on the intake air amount detected by airflow meter 42 (S202). In addition, the air-fuel ratio is detected based on the signal transmitted from air-fuel ratio sensor 420 (S204), and the learn value in the identified injection region and learning region is calculated (S206).

As the learn value is calculated only when the predetermined learning condition is satisfied, a certain period of time is necessary for calculating the learn value. Therefore, it is not always the case that the learn value for all learning regions is quickly calculated after the start of operation of engine 10. Therefore, in order to appropriately correct the amount of fuel injection in the learning region where the learn value has not yet been calculated, the learn value should be set provisionally.

Accordingly, whether or not there is other learning region where the learn value has been calculated in the injection region identical to the injection region where the learn value had been calculated is identified (S208). It is assumed here that solely the learn value in learning region (1) in each injection region was calculated, as shown in FIG. 11. In FIG. 11, squares indicate learn values in the region where DI ratio r=100%, circles indicate learn values in the region where 0%<DI ratio r<100%, and triangles indicate learn values in the region where DI ratio r=0%.

Here, as the learn value has not yet been calculated in other learning region (S208), the learn value in learning region (1) where calculation of the learn value has been completed is used as shown in FIG. 12, and the learn values in learning regions (2) to (4) are provisionally set. Specifically, the learn value in learning regions (2) to (4) is set to a value within a range of ±X % from the learn value in learning region (1).

Though FIG. 12 shows solely the learn values in the region where 0%<DI ratio r<100%, similar provisional setting (setting of the learn value) is made also in other injection regions for each injection region.

Namely, the learn value in learning regions (2) to (4) within the region where DI ratio r=100% is set based on the learn value in learning region (1) within the region where DI ratio r=100%. Similarly, the learn value in learning regions (2) to (4) within the region where DI ratio r=0% is set based on the learn value in learning region (1) within the region where DI ratio r=0%. In this manner, the learn value in the learning region where an occasion to calculate the learn value has not yet been obtained can quickly be obtained.

The amount of fuel injection from in-cylinder injector 110 and the amount of fuel injection from intake manifold injector 120 are corrected based on the learn value obtained in the above-described manner (S212). Therefore, the fuel injection amount can appropriately be corrected in the learning region where an occasion to calculate the learn value has not yet been obtained.

As described above, according to the engine ECU serving as the control device for the internal combustion engine of the present embodiment, provisional setting of the learn value in the learning region where the learn value has not been calculated is made based on the actually calculated learn value. Therefore, the learn value in the learning region where an occasion to calculate the learn value has not yet been obtained can quickly be obtained. Accordingly, the fuel injection amount can appropriately be corrected also in the learning region where an occasion to calculate the learn value has not yet been obtained. Consequently, the air-fuel ratio can be controlled to attain an appropriate state and exhaust emission performance can be improved.

In the present embodiment, the learn value in other learning region is set based on the learn value in one learning region out of a plurality of learning regions, however, the learn value in other learning region may be set based on the learn values in two or more learning regions.

Third Embodiment

Figure 13:
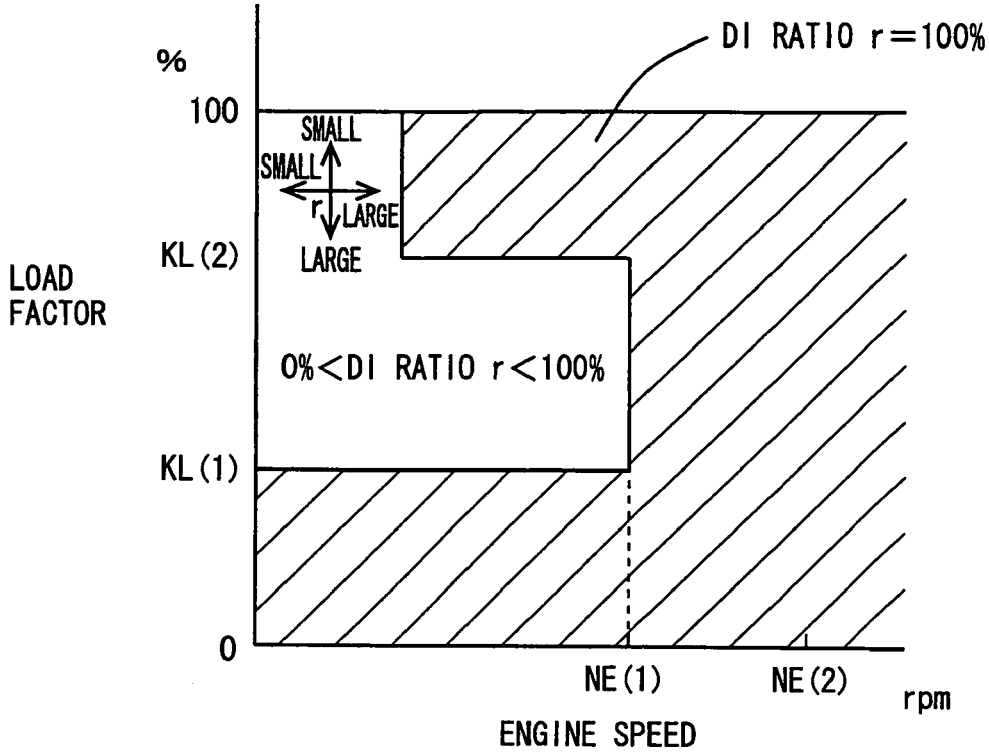
FIGS. 13 and 14 illustrate DI ratio maps in a warm state and a cold state respectively, stored in an engine ECU serving as a control device according to a third embodiment of the present invention.
Figure 14:
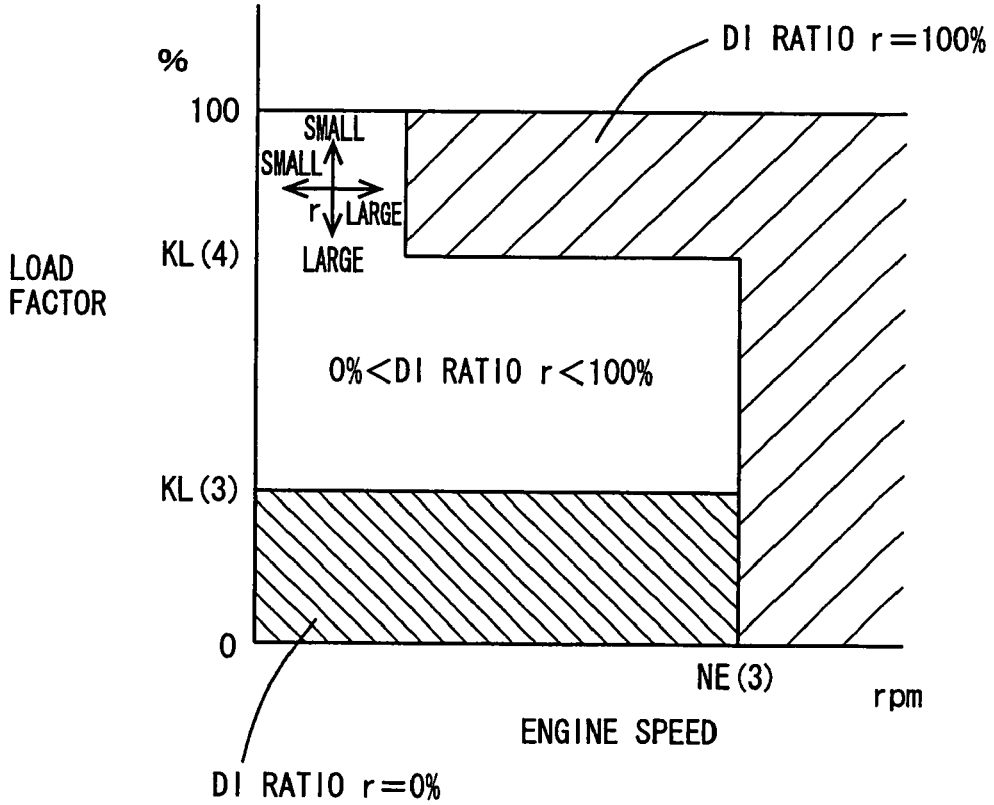

Referring to FIGS. 13 and 14, a third embodiment of the present invention will be described. In the present embodiment, DI ratio r is calculated using a map different from those in the first embodiment described previously.

As the configuration and the process flow as well as functions thereof are otherwise the same as those in the first embodiment described previously, detailed description thereof will not be repeated.

Referring to FIGS. 13 and 14, maps each indicating the fuel injection ratio between in-cylinder injector 110 and intake manifold injector 120, identified as information associated with the operation state of engine 10, will be described. The maps are stored in ROM 320 of engine ECU 300. FIG. 13 is the map for the warm state of engine 10, and FIG. 14 is the map for the cold state of engine 10.

FIGS. 13 and 14 differ from FIGS. 2 and 3 in the following points. "DI RATIO r=100%" holds in the region where the engine speed of engine 10 is equal to or higher than NE(1) in the map for the warm state, and in the region where engine 10 speed is NE(3) or higher in the map for the cold state. Further, except for the low-speed region, "DI RATIO r=100%" holds in the region where the load factor is KL(2) or greater in the map for the warm state, and in the region where the load factor is KL(4) or greater in the map for the cold state. This means that fuel injection is carried out using only in-cylinder injector 110 in the region where the engine speed is at a predetermined high level, and that fuel injection is often carried out using only in-cylinder injector 110 in the region where the engine load is at a predetermined high level. However, in the low-speed and high-load region, mixing of an air-fuel mixture formed by the fuel injected from in-cylinder injector 110 is poor, and such inhomogeneous air-fuel mixture within the combustion chamber may lead to unstable combustion. Thus, the fuel injection ratio of the in-cylinder injector is increased as the engine speed increases where such a problem is unlikely to occur, whereas the fuel injection ratio of in-cylinder injector 110 is decreased as the engine load increases where such a problem is likely to occur. These changes in the DI ratio r are shown by crisscross arrows in FIGS. 13 and 14. In this manner, variation in output torque of the engine attributable to the unstable combustion can be suppressed. It is noted that these measures are approximately equivalent to the measures to decrease the fuel injection ratio of in-cylinder injector 110 as the state of engine 10 moves toward the predetermined low speed region, or to increase the fuel injection ratio of in-cylinder injector 110 as engine 10 state moves toward the predetermined low load region. Further, except for the relevant region (indicated by the crisscross arrows in FIGS. 13 and 14), in the region where fuel injection is carried out using only in-cylinder injector 110 (on the high speed side and on the low load side), a homogeneous air-fuel mixture is readily obtained even when the fuel injection is carried out using only in-cylinder injector 110. In this case, the fuel injected from in-cylinder injector 110 is atomized within the combustion chamber involving latent heat of vaporization (by absorbing heat from the combustion chamber). Accordingly, the temperature of the air-fuel mixture is decreased at the compression end, and thus, the antiknock performance improves. Further, with the temperature of the combustion chamber decreased, intake efficiency improves, leading to high power output.

In engine 10 explained in the first and second embodiments, homogeneous combustion is achieved by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in the combustion chamber as a whole is ignited to realize the stratified charge combustion. Even if the fuel injection timing of in-cylinder injector 110 is set in the intake stroke, stratified charge combustion can be realized if it is possible to provide a rich air-fuel mixture locally around the spark plug.

As used herein, the stratified charge combustion includes both the stratified charge combustion and semi-stratified charge combustion. In the semi-stratified charge combustion, intake manifold injector 120 injects fuel in the intake stroke to generate a lean and homogeneous air-fuel mixture in the whole combustion chamber, and then in-cylinder injector 110 injects fuel in the compression stroke to generate a rich air-fuel mixture around the spark plug, so as to improve the combustion state. Such semi-stratified charge combustion is preferable in the catalyst warm-up operation for the following reasons. In the catalyst warm-up operation, it is necessary to considerably retard the ignition timing and maintain a favorable combustion state (idle state) so as to cause a high-temperature combustion gas to reach the catalyst. Further, a certain quantity of fuel needs to be supplied. If the stratified charge combustion is employed to satisfy these requirements, the quantity of the fuel will be insufficient. If the homogeneous combustion is employed, the retarded amount for the purpose of maintaining favorable combustion is small compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine explained in the first and second embodiments, the fuel injection timing of in-cylinder injector 110 is preferably set in the intake stroke in a basic region corresponding to the almost entire region (here, the basic region refers to the region other than the region where semi-stratified charge combustion is carried out with fuel injection from intake manifold injector 120 in the intake stroke and fuel injection from in-cylinder injector 110 in the compression stroke, which is carried out only in the catalyst warm-up state). The fuel injection timing of in-cylinder injector 110, however, may be set temporarily in the compression stroke for the purpose of stabilizing combustion, for the following reasons.

When the fuel injection timing of in-cylinder injector 110 is set in the compression stroke, the air-fuel mixture is cooled by the injected fuel while the temperature in the cylinder is relatively high. This improves the cooling effect and, hence, the antiknock performance. Further, when the fuel injection timing of in-cylinder injector 110 is set in the compression stroke, the time from the fuel injection to the ignition is short, which ensures strong penetration of the sprayed fuel, so that the combustion rate increases. The improvement in antiknock performance and the increase in combustion rate can prevent variation in combustion, and thus, combustion stability is improved.

Regardless of the temperature of engine 10 (that is, whether engine 10 is in the warm state or in the cold state), the warm state map shown in FIG. 2 or 13 may be used during idle-off state (when an idle switch is off, or when the accelerator pedal is pressed) (regardless of whether engine 10 is in the cold state or in the warm state, in the low load region, in-cylinder injector 110 is used).

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control device for an internal combustion engine, said internal combustion engine including a first fuel injection mechanism injecting fuel into a cylinder and a second fuel injection mechanism injecting fuel into an intake manifold, comprising:

a first control unit controlling said fuel injection mechanism so that the fuel is injected solely from said first fuel injection mechanism in a first injection region;

a second control unit controlling said fuel injection mechanism so that the fuel is injected solely from said second fuel injection mechanism in a second injection region;

a third control unit controlling said fuel injection mechanism so that the fuel is injected from said first fuel injection mechanism and said second fuel injection mechanism in a third injection region;

a detection unit detecting an amount of air suctioned into said internal combustion engine;

a first correction value calculation unit calculating a first correction value for an amount of fuel injection in said first injection region, for a plurality of learning regions obtained as a result of division corresponding to said amount of air;

a second correction value calculation unit calculating a second correction value for an amount of fuel injection in said second injection region, for the plurality of learning regions;

a third correction value calculation unit calculating a third correction value for an amount of fuel injection in said third injection region, for the plurality of learning regions;

a first calculation unit calculating a correction value for an amount of fuel injection at an amount of air different from the amount of air detected when said first correction value is calculated, based on said first correction value;

a second calculation unit calculating a correction value for an amount of fuel injection at an amount of air different from the amount of air detected when said second correction value is calculated, based on said second correction value; and a third calculation unit calculating a correction value for an amount of fuel injection at an amount of air different from the amount of air detected when said third correction value is calculated, based on said third correction value.

2. The control device for an internal combustion engine according to claim 1, wherein said first calculation unit calculates the correction value for the amount of fuel injection at the amount of air different from the amount of air detected when a plurality of said first correction values are calculated, based on said plurality of said first correction values, said second calculation unit calculates the correction value for the amount of fuel injection at the amount of air different from the amount of air detected when a plurality of said second correction values are calculated, based on said plurality of said second correction values, and said third calculation unit calculates the correction value for the amount of fuel injection at the amount of air different from the amount of air detected when a plurality of said third correction values are calculated, based on said plurality of said third correction values.

3. The control device for an internal combustion engine according to claim 1, wherein said third control unit controls said fuel injection mechanism by including at least a first ratio and a second ratio in a ratio between an amount of injection from said first fuel injection mechanism and an amount of injection from said second fuel injection mechanism, and said third calculation unit provides an identical correction value when said ratio of injection amount is set to said first ratio and when said ratio of injection amount is set to said second ratio.

4. The control device for an internal combustion engine according to claim 1, wherein said first control unit controls said fuel injection mechanism so that the amount of injection from said first fuel injection mechanism is corrected based on the correction value calculated by said first calculation unit, said second control unit controls said fuel injection mechanism so that the amount of injection from said second fuel injection mechanism is corrected based on the correction value calculated by said second calculation unit, and said third control unit controls said fuel injection mechanism so that at least one of the amount of injection from said first fuel injection mechanism and the amount of injection from said second fuel injection mechanism is corrected based on the correction value calculated by said third calculation unit.

5. The control device for an internal combustion engine according to claim 1, wherein said first fuel injection mechanism is an in-cylinder injector, and said second fuel injection mechanism is an intake manifold injector.

6. A control device for an internal combustion engine, said internal combustion engine including a first fuel injection mechanism injecting fuel into a cylinder and a second fuel injection mechanism injecting fuel into an intake manifold, comprising:

a control unit controlling said fuel injection mechanism so that the fuel is injected from said first fuel injection mechanism and said second fuel injection mechanism in a predetermined injection region;

a detection unit detecting an amount of air suctioned into said internal combustion engine;

a correction value calculation unit calculating a correction value for an amount of fuel injection in said predetermined injection region, for a plurality of learning regions obtained as a result of division corresponding to said amount of air; and a calculation unit calculating a correction value for an amount of fuel injection at an amount of air different from the amount of air detected when said correction value is calculated, based on said correction value.

7. The control device for an internal combustion engine according to claim 6, wherein said calculation unit calculates the correction value for the amount of fuel injection at the amount of air different from the amount of air detected when a plurality of said correction values are calculated, based on said plurality of said correction values.

8. The control device for an internal combustion engine according to claim 6, wherein said control unit controls said fuel injection mechanism by including at least a first ratio and a second ratio in a ratio between an amount of injection from said first fuel injection mechanism and an amount of injection from said second fuel injection mechanism, and said calculation unit provides an identical correction value when said ratio of injection amount is set to said first ratio and when said ratio of injection amount is set to said second ratio.

9. The control device for an internal combustion engine according to claim 6, wherein said control unit controls said fuel injection mechanism so that at least one of the amount of injection from said first fuel injection mechanism and the amount of injection from said second fuel injection mechanism is corrected based on the correction value calculated by said calculation unit.

10. A control device for an internal combustion engine, said internal combustion engine including a first fuel injection mechanism injecting fuel into a cylinder and a second fuel injection mechanism injecting fuel into an intake manifold, comprising:

a first control unit controlling said fuel injection mechanism so that the fuel is injected solely from said first fuel injection mechanism in a first injection region;

a second control unit controlling said fuel injection mechanism so that the fuel is injected solely from said second fuel injection mechanism in a second injection region;

a third control unit controlling said fuel injection mechanism so that the fuel is injected from said first fuel injection mechanism and said second fuel injection mechanism in a third injection region;

a detection unit detecting an amount of air suctioned into said internal combustion engine;

a first calculation unit calculating a first correction value for an amount of fuel injection in said first injection region, for at least one of a plurality of learning regions obtained as a result of division corresponding to said amount of air;

a second calculation unit calculating a second correction value for an amount of fuel injection in said second injection region, for at least one of the plurality of learning regions;

a third calculation unit calculating a third correction value for an amount of fuel injection in said third injection region, for at least one of the plurality of learning regions;

a first setting unit setting a first correction value in other learning region based on the first correction value calculated by said first calculation unit;

a second setting unit setting a second correction value in other learning region based on the second correction value calculated by said second calculation unit; and a third setting unit setting a third correction value in other learning region based on the third correction value calculated by said third calculation unit.

11. The control device for an internal combustion engine according to claim 10, wherein said first setting unit sets the first correction value in other learning region such that deviation from the first correction value calculated by said first calculation unit is within a predetermined range, said second setting unit sets the second correction value in other learning region such that deviation from the second correction value calculated by said second calculation unit is within a predetermined range, and said third setting unit sets the third correction value in other learning region such that deviation from the third correction value calculated by said third calculation unit is within a predetermined range.

12. The control device for an internal combustion engine according to claim 10, wherein said first setting unit sets the first correction value in other learning region to be equal to the first correction value calculated by said first calculation unit, said second setting unit sets the second correction value in other learning region to be equal to the second correction value calculated by said second calculation unit, and said third setting unit sets the third correction value in other learning region to be equal to the third correction value calculated by said third calculation unit.

13. A control device for an internal combustion engine, said internal combustion engine including a first fuel injection mechanism injecting fuel into a cylinder and a second fuel injection mechanism injecting fuel into an intake manifold, comprising:

a control unit controlling said fuel injection mechanism so that the fuel is injected from said first fuel injection mechanism and said second fuel injection mechanism in a predetermined injection region;

a detection unit detecting an amount of air suctioned into said internal combustion engine;

a calculation unit calculating a correction value for an amount of fuel injection in said predetermined injection region, for at least one of a plurality of learning regions obtained as a result of division corresponding to said amount of air; and a setting unit setting a correction value in other learning region based on the correction value calculated by said calculation unit.

14. The control device for an internal combustion engine according to claim 13, wherein said setting unit sets the correction value in other learning region such that deviation from the correction value calculated by said calculation unit is within a predetermined range.

15. The control device for an internal combustion engine according to claim 13, wherein said setting unit sets the correction value in other learning region to be equal to the correction value calculated by said calculation unit.

16. A control device for an internal combustion engine, said internal combustion engine including first fuel injection means for injecting fuel into a cylinder and second fuel injection means for injecting fuel into an intake manifold, comprising:

first control means for controlling said fuel injection means so that the fuel is injected solely from said first fuel injection means in a first injection region;

second control means for controlling said fuel injection means so that the fuel is injected solely from said second fuel injection means in a second injection region;

third control means for controlling said fuel injection means so that the fuel is injected from said first fuel injection means and said second fuel injection means in a third injection region;

means for detecting an amount of air suctioned into said internal combustion engine;

means for calculating a first correction value for an amount of fuel injection in said first injection region, for a plurality of learning regions obtained as a result of division corresponding to said amount of air;

means for calculating a second correction value for an amount of fuel injection in said second injection region, for the plurality of learning regions;

means for calculating a third correction value for an amount of fuel injection in said third injection region, for the plurality of learning regions;

first calculation means for calculating a correction value for an amount of fuel injection at an amount of air different from the amount of air detected when said first correction value is calculated, based on said first correction value;

second calculation means for calculating a correction value for an amount of fuel injection at an amount of air different from the amount of air detected when said second correction value is calculated, based on said second correction value; and third calculation means for calculating a correction value for an amount of fuel injection at an amount of air different from the amount of air detected when said third correction value is calculated, based on said third correction value.

17. The control device for an internal combustion engine according to claim 16, wherein said first calculation means includes means for calculating the correction value for the amount of fuel injection at the amount of air different from the amount of air detected when a plurality of said first correction values are calculated, based on said plurality of said first correction values, said second calculation means includes means for calculating the correction value for the amount of fuel injection at the amount of air different from the amount of air detected when a plurality of said second correction values are calculated, based on said plurality of said second correction values, and said third calculation means includes means for calculating the correction value for the amount of fuel injection at the amount of air different from the amount of air detected when a plurality of said third correction values are calculated, based on said plurality of said third correction values.

18. The control device for an internal combustion engine according to claim 16, wherein said third control means includes means for controlling said fuel injection means by including at least a first ratio and a second ratio in a ratio between an amount of injection from said first fuel injection means and an amount of injection from said second fuel injection means, and said third calculation means includes means for providing an identical correction value when said ratio of injection amount is set to said first ratio and when said ratio of injection amount is set to said second ratio.

19. The control device for an internal combustion engine according to claim 16, wherein said first control means includes means for controlling said fuel injection means so that the amount of injection from said first fuel injection means is corrected based on the correction value calculated by said first calculation means, said second control means includes means for controlling said fuel injection means so that the amount of injection from said second fuel injection means is corrected based on the correction value calculated by said second calculation means, and said third control means includes means for controlling said fuel injection means so that at least one of the amount of injection from said first fuel injection means and the amount of injection from said second fuel injection means is corrected based on the correction value calculated by said third calculation means.

20. The control device for an internal combustion engine according to any one of claims claim 16, wherein said first fuel injection means is an in-cylinder injector, and said second fuel injection means is an intake manifold injector.

21. A control device for an internal combustion engine, said internal combustion engine including first fuel injection means for injecting fuel into a cylinder and second fuel injection means for injecting fuel into an intake manifold, comprising:

control means for controlling said fuel injection means so that the fuel is injected from said first fuel injection means and said second fuel injection means in a predetermined injection region;

means for detecting an amount of air suctioned into said internal combustion engine;

means for calculating a correction value for an amount of fuel injection in said predetermined injection region, for a plurality of learning regions obtained as a result of division corresponding to said amount of air; and means for calculating a correction value for an amount of fuel injection at an amount of air different from the amount of air detected when said correction value is calculated, based on said correction value.

22. The control device for an internal combustion engine according to claim 21, wherein said calculation means includes means for calculating the correction value for the amount of fuel injection at the amount of air different from the amount of air detected when a plurality of said correction values are calculated, based on said plurality of said correction values.

23. The control device for an internal combustion engine according to claim 21, wherein said control means includes means for controlling said fuel injection means by including at least a first ratio and a second ratio in a ratio between an amount of injection from said first fuel injection means and an amount of injection from said second fuel injection means, and said calculation means includes means for providing an identical correction value when said ratio of injection amount is set to said first ratio and when said ratio of injection amount is set to said second ratio.

24. The control device for an internal combustion engine according to claim 21, wherein said control means includes means for controlling said fuel injection means so that at least one of the amount of injection from said first fuel injection means and the amount of injection from said second fuel injection means is corrected based on the correction value calculated by said calculation means.

25. A control device for an internal combustion engine, said internal combustion engine including first fuel injection means for injecting fuel into a cylinder and second fuel injection means for injecting fuel into an intake manifold, comprising:

first control means for controlling said fuel injection means so that the fuel is injected solely from said first fuel injection means in a first injection region;

second control means for controlling said fuel injection means so that the fuel is injected solely from said second fuel injection means in a second injection region;

third control means for controlling said fuel injection means so that the fuel is injected from said first fuel injection means and said second fuel injection means in a third injection region;

means for detecting an amount of air suctioned into said internal combustion engine;

first calculation means for calculating a first correction value for an amount of fuel injection in said first injection region, for at least one of a plurality of learning regions obtained as a result of division corresponding to said amount of air;

second calculation means for calculating a second correction value for an amount of fuel injection in said second injection region, for at least one of the plurality of learning regions;

third calculation means for calculating a third correction value for an amount of fuel injection in said third injection region, for at least one of the plurality of learning regions;

first setting means for setting a first correction value in other learning region based on the first correction value calculated by said first calculation means;

second setting means for setting a second correction value in other learning region based on the second correction value calculated by said second calculation means; and third setting means for setting a third correction value in other learning region based on the third correction value calculated by said third calculation means.

26. The control device for an internal combustion engine according to claim 25, wherein said first setting means includes means for setting the first correction value in other learning region such that deviation from the first correction value calculated by said first calculation means is within a predetermined range, said second setting means includes means for setting the second correction value in other learning region such that deviation from the second correction value calculated by said second calculation means is within a predetermined range, and said third setting means includes means for setting the third correction value in other learning region such that deviation from the third correction value calculated by said third calculation means is within a predetermined range.

27. The control device for an internal combustion engine according to claim 25, wherein said first setting means includes means for setting the first correction value in other learning region to be equal to the first correction value calculated by said first calculation means, said second setting means includes means for setting the second correction value in other learning region to be equal to the second correction value calculated by said second calculation means, and said third setting means includes means for setting the third correction value in other learning region to be equal to the third correction value calculated by said third calculation means.

28. A control device for an internal combustion engine, said internal combustion engine including first fuel injection means for injecting fuel into a cylinder and second fuel injection means for injecting fuel into an intake manifold, comprising:

control means for controlling said fuel injection means so that the fuel is injected from said first fuel injection means and said second fuel injection means in a predetermined injection region;

means for detecting an amount of air suctioned into said internal combustion engine;

calculation means for calculating a correction value for an amount of fuel injection in said predetermined injection region, for at least one of a plurality of learning regions obtained as a result of division corresponding to said amount of air; and setting means for setting a correction value in other learning region based on the correction value calculated by said calculation means.

29. The control device for an internal combustion engine according to claim 28, wherein said setting means includes means for setting the correction value in other learning region such that deviation from the correction value calculated by said calculation means is within a predetermined range.

30. The control device for an internal combustion engine according to claim 28, wherein said setting means includes means for setting the correction value in other learning region to be equal to the correction value calculated by said calculation means.

* * * * *